US006412808B1

(12) United States Patent
Chevalier et al.

(10) Patent No.: US 6,412,808 B1
(45) Date of Patent: Jul. 2, 2002

(54) BOOT/SKI SAFETY BINDING

(75) Inventors: Jean-Louis Chevalier, Varennes Vauzelles; Jean-Marc Hillairet; Christophe Juge, both of Nevers, all of (FR)

(73) Assignee: Look Fixations S.A., Nevers (FR)

( * ) Notice: Subject to any disclaimer, the term of this patent is extended or adjusted under 35 U.S.C. 154(b) by 0 days.

(21) Appl. No.: 09/495,287

(22) Filed: Jan. 31, 2000

(30) Foreign Application Priority Data

Feb. 2, 1999 (FR) ..... 99 01328

(51) Int. Cl.[7] ..... A63C 9/08
(52) U.S. Cl. ..... 280/611; 280/618; 280/613
(58) Field of Search ..... 280/611, 618, 280/613, 627, 624, 616, 607, 623, 625, 626, 632, 14.22, 14.21, 14.2, 620; 292/216, 337, 341.17, 341.15, 341.13, 302

(56) References Cited

U.S. PATENT DOCUMENTS

| | | | | | |
|---|---|---|---|---|---|
| 4,145,071 | A | * | 3/1979 | Salomon | 280/624 |
| 4,177,584 | A | | 12/1979 | Beyl | |
| 4,182,524 | A | | 1/1980 | Beyl | |
| 4,561,672 | A | * | 12/1985 | Spitaler | 280/618 |
| 4,875,724 | A | * | 10/1989 | Gruber | 292/216 |
| 5,209,530 | A | * | 5/1993 | Kolloch | 292/337 |
| 5,505,477 | A | * | 4/1996 | Turner et al. | 280/613 |
| 5,941,553 | A | * | 8/1999 | Korman | 280/613 |
| 6,105,996 | A | * | 8/2000 | France | 280/624 |

FOREIGN PATENT DOCUMENTS

| | | | | |
|---|---|---|---|---|
| DE | 3405861 A1 | * | 2/1984 | 280/611 |
| DE | 3412887 A1 | * | 4/1984 | 280/611 |
| DE | 3437143 C1 | * | 10/1984 | 280/611 |
| DE | 3711284 A1 | * | 4/1987 | 280/611 |
| DE | 29608660 U | | 8/1996 | |
| EP | 0 408 824 | | 1/1991 | |
| WO | WO 97 22390 A | | 6/1997 | |

OTHER PUBLICATIONS

French Preliminary Search Report in SN FR 9901328.

* cited by examiner

*Primary Examiner*—Lanna Mai
*Assistant Examiner*—Hau Phan
(74) *Attorney, Agent, or Firm*—Bugnion S.A.; John Moetteli

(57) ABSTRACT

The assembly consists of a boot whose sole (42) is fitted with a transverse bar (38) which engages between a bearing piece (11) and a self-locking cam (29). The bearing piece (11) is secured to a sliding piece (10) and the cam (29) is mounted on a piece (19) which preferably slides. These two pieces are mounted in a rail (2, 3) while being drawn toward one another by springs (16). The bar (38) can be disengaged by means of a lever (32). This binding releases both in the event of falling forward or backward and in response to twisting.

14 Claims, 4 Drawing Sheets

BOOT/SKI SAFETY BINDING

BACKGROUND OF THE INVENTION

The present invention relates to a boot/ski binding assembly which can release in the event of falling both forward or backward and in response to twisting, consisting of a boot whose sole is fitted with a transverse bar and of a binding which has a longitudinal direction and a transverse direction and comprises means for retaining the boot by its bar.

U.S. Pat. No. 4,182,524, the content of which is incorporated by reference, discloses a boot/binding assembly in which the boot is fitted with two bars projecting on each side of the boot so as to form two pairs of studs used to secure the boot to a plate of the binding, this plate being itself mounted on a central block on which it is retained elastically in rotation by two rectangular frames bearing on two opposite flats of the central block. In this assembly, the means for releasing, on the one hand, when falling forward or backward and, on the other, in response to twisting, are separate from one another and are each controlled by their own elastic disengagement device. This binding is relatively complicated, and the studs form inappropriate projections on each side of the boot. Also, removing the boot from the binding requires compression of the release springs retaining the boot on the plate, and hence considerable effort.

Further, Patent Application EP 0 408 824, the content of which is incorporated by reference, discloses a boot/binding assembly in which the boot is fitted with two substantially vertical plates articulated about two axes parallel to the longitudinal direction of the boot, these plates interacting with retaining rollers that can be moved apart from one another when the boot is being fitted in the binding and in the event of falling forward or backward. These retaining rollers are mounted on a plate which is itself mounted on a central block about which the plate can pivot in the event of twisting forces, against the action of two springs. In this case as well, the means for releasing when falling forward or backward and in response to twisting are separate means controlled by their own spring an associated mechanism. In order to remove the boot intentionally, it is necessary to move apart the plates mounted on the boot, so that the means for actuating these plates are also located on the boot, which encumbers and complicates the boot.

U.S. Pat. No. 4,177,584, the content of which is incorporated by reference, presents a boot fitted with two transverse bars extending laterally beyond the sole on each side of the boot so as to form two pairs of studs intended to be retained by two pairs of arms of a ski binding. This binding is not described in this document, but it can be seen from the drawings that release in response to twisting is not possible.

Further, International Patent Application WO 97/22390, the content of which is incorporated by reference, discloses a snowboard binding consisting of a stirrup provided with two notches in which the transverse bar fitted to the boot engages by moving apart a pair of cams automatically wedging the bar in the notches. This binding does not, however, have any means of releasing the boot in the event of falling, and it is hence not a safety binding.

The safety bindings mentioned above are also susceptible to the build-up of snow which can easily prevent the boot from being fitted in the binding.

SUMMARY OF THE INVENTION

The object of the present invention is to provide a boot/ski binding assembly which is simpler than the assemblies known from the prior art, is less susceptible to the build-up of snow in the binding and requires less effort for removing the boot from the binding.

The boot/ski binding assembly according to the invention is one wherein the boot-retaining means located on the binding consist, on the one hand, of a transverse recess which has a notch-shaped profile and is formed between two pieces, at least one of which can be moved longitudinally against the action of at least one spring, and, on the other, of a self-locking cam articulated about an axis transverse to the binding on one of the pieces and urged to rotate by a spring tending to keep it engaged in the recess, the shape of the surface of the cam intended to come into contact with the bar being such that the bar, once engaged in the recess after having moved the cam away, tends to move the cam with it by friction when an upward force is exerted on the bar, so that the bar stays locked in the recess by wedging between the cam and the retaining piece which is not supporting the cam.

The boot is fitted with a single bar which does not extend laterally beyond the sole and works in its central region. In the event of falling, the effect of the force exerted on the bar is to push back the moving piece or pieces by bearing on the cam, both in the case when the bar experiences a force directed upward and when it experiences a twisting force. A single, relatively simple, system hence makes it possible to control release when falling forward or backward and release in response to twisting.

Given that the cam works as an element for taking up play and allows the bar to be wedged at any height over a certain range, the boot/binding assembly according to the invention is substantially unsusceptible to the build-up of snow in and on the binding. It is always possible to fit the boot in the binding quickly.

The boot can be fitted in the binding without effort, because this does not involve compressing the release spring or springs. When the boot is being fitted in the binding, the bar simply needs to move the cam away, optionally against the action of a weak return spring whose resistance is not in any event felt by the user.

Similarly, the boot is removed from the binding by acting on the cam, that is to say by pivoting it in the opposite direction to its locking direction. In this case as well, it is not necessary to compress the release spring.

According to a preferred embodiment of the invention, the two pieces of the retaining means can be moved longitudinally against the action of at least one common spring working in compression between two parts respectively secured to each of the two pieces.

The means for releasing the boot advantageously consist of a lever and a connecting element, such as a tie bent at its end, for rotating the cam in the opposite direction to its locking direction. This lever may be articulated to the front or rear of the binding for it to be actuated by hand or using a ski pole.

BRIEF DESCRIPTION OF THE DRAWINGS

The appended drawing represents two embodiments of the invention by way of example.

DETAILED DESCRIPTION OF THE PREFERRED EMBODIMENTS

Figure 1:
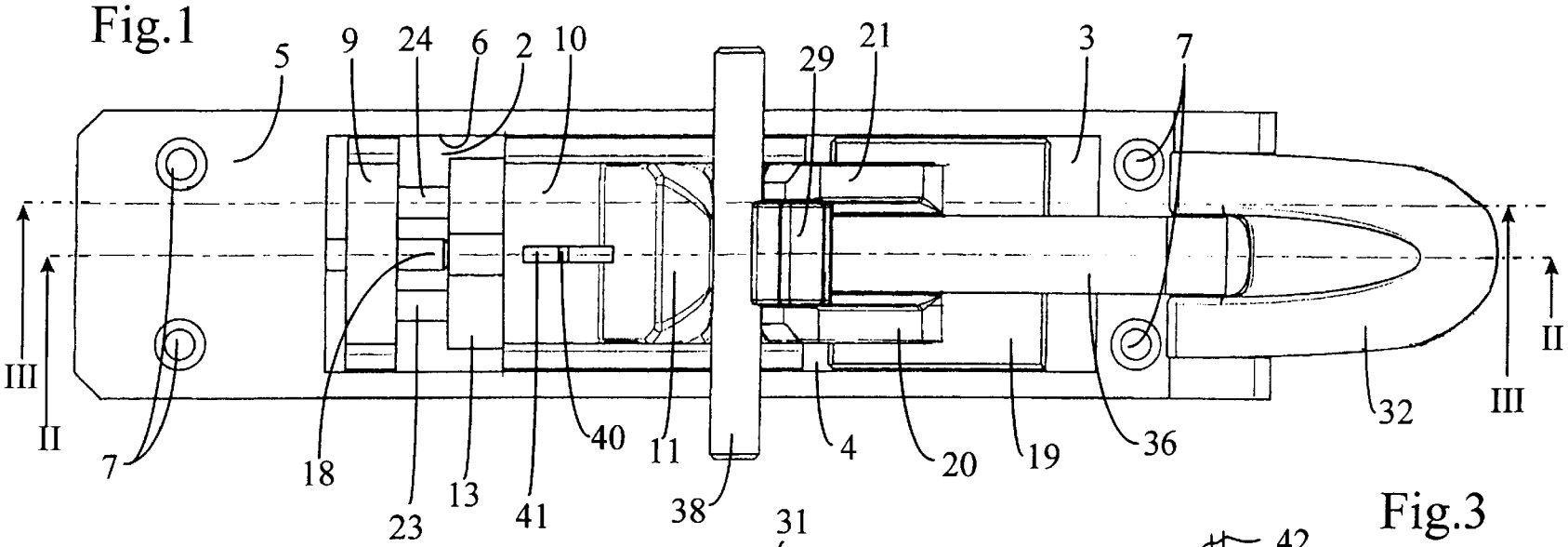
FIG. 1 is a plan view of the binding and of the bar of the boot fixed to the binding, but without the boot, according to a first embodiment.

In the first embodiment, the body of the binding consists of a plate 1 having a thickness of about 2 cm, but in any event sufficient to make it possible for two recesses 2 and 3 of rectangular parallelepipedal shape, extending longitudinally one after the other over the majority of the length of the plate 1 and separated by a cut-out wall 4, to be formed in it. A thin plate 5, having a rectangular cut-out 6 whose width is slightly less than the width of the recesses 2 and 3, is fixed on the plate 1 so as to form a rail with a T-shaped profile. Such a rail could, of course, have been machined in the plate 1, but in this case it would have had to have opened at least at one of the ends of the plate 1. The plate 1 is provided with four holes 7 for fastening it to a ski.

Figure 2:
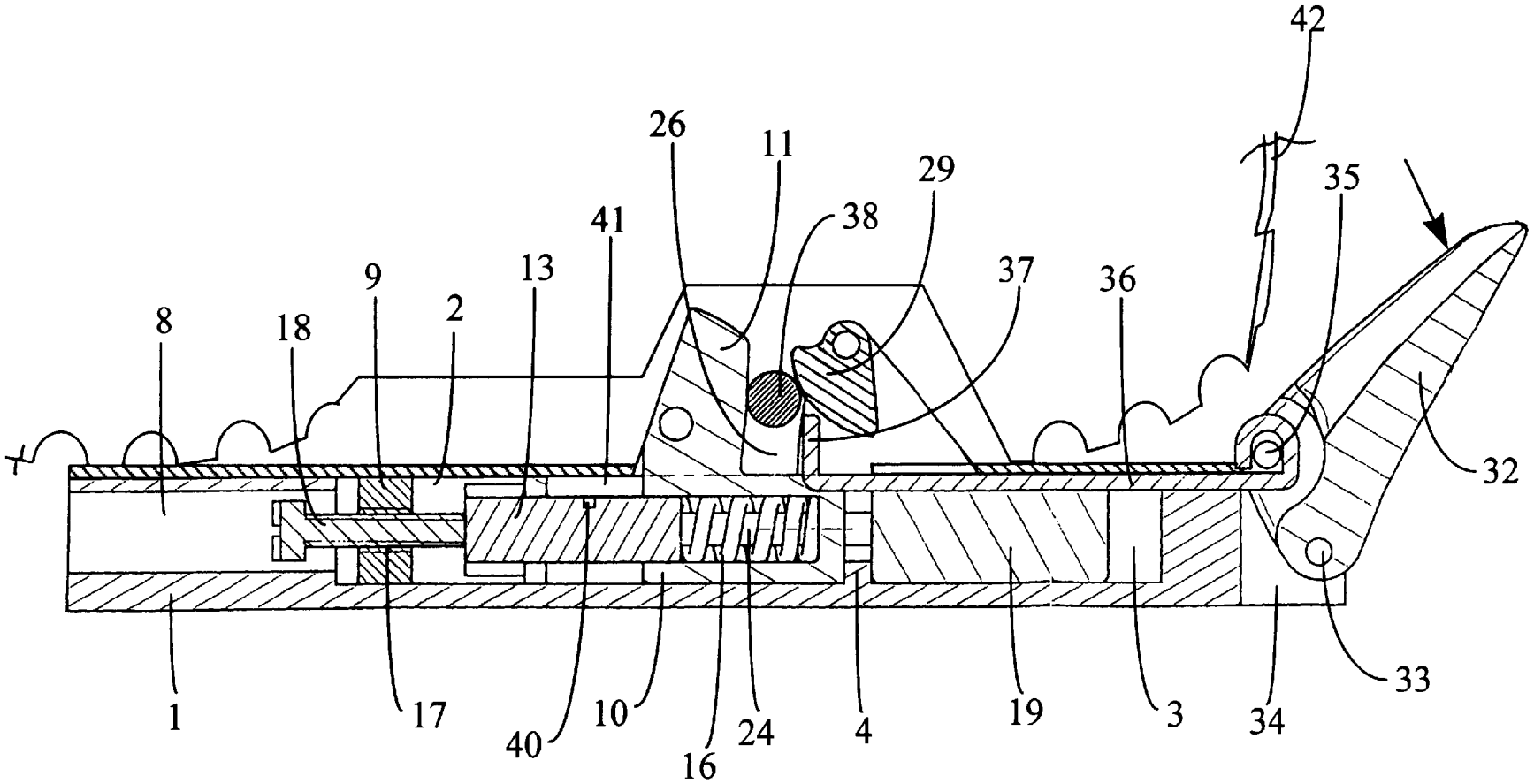
FIG. 2 is a view in section on II—II of FIG. 1 in which the profile of the sole is represented.
Figure 4:
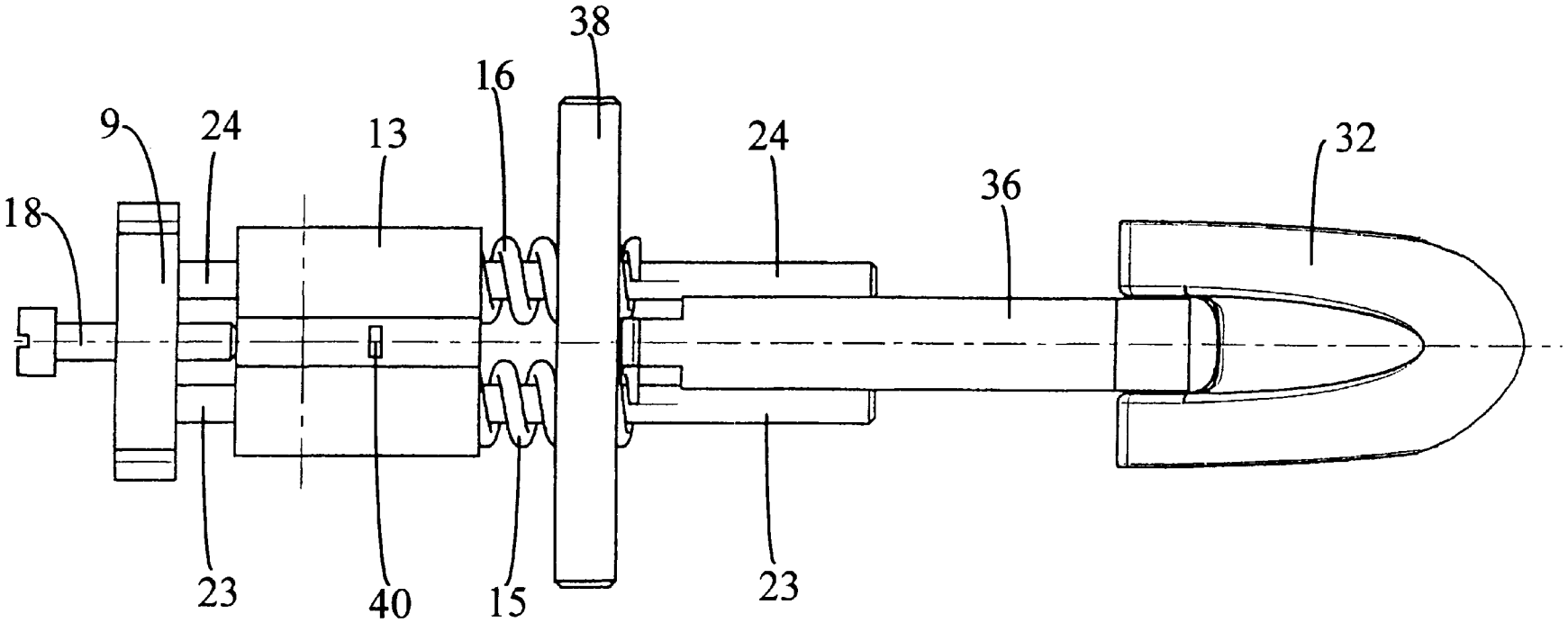
FIG. 4 is a plan view of the moving elements of the binding, but without the retaining pieces, in which the bar of the boot is also represented in order to locate the position of these moving elements.

The plate 1 also has, at one of its ends, a cylindrical axial hole 8 opening into the part 2 of the rail (FIG. 2).

Two sliding pieces of rectangular shape 9 and 10 are mounted in the part 2 of the rail. The piece 10 consists of a first retaining piece fitted with a jaw 11 rising above the plate 1. The piece 10 is set back in its horizontal part so as to form a hollow 12 in which a piston 13, having two parallel cylindrical indentations such as the indentation 14 (FIG. 3), is mounted so as to slide, which indentations respectively accommodate two identical parallel springs 15 and 16 working in compression between the bottom of the hollow of the piece 12 and the piston 13. The piece 9 has a threaded axial hole 17 whose axis lies in the vertical plane of symmetry of the plate 1. This hole 17 engages on a screw 18 which is accessible through the hole 8 in the plate and bears on the piston 13.

Figure 3:
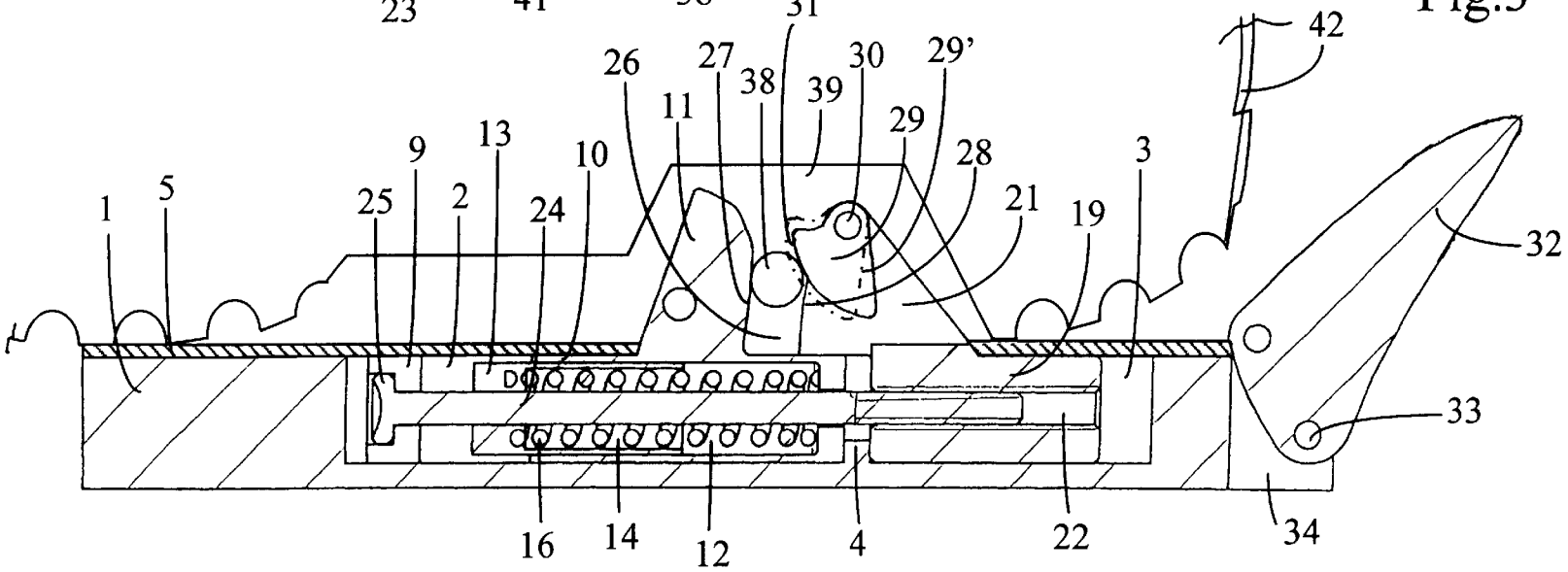
FIG. 3 is a view in section on III—III of FIG. 1.

A second piece 19, also sliding in the rail and of rectangular shape, from which a pair of parallel supports 20 and 21 facing the jaw 11 rise, is mounted in the other part 3 of the rail. The piece 19 also has two threaded holes parallel to the axis of the rail, such as the hole 22 (FIG. 3). The threaded ends of two rods 23 and 24, provided with a head 25 by which these rods bear on the piece 9, are respectively screwed into these holes.

It can be seen that the sliding piece 9, which tends to be pushed back by the piston 13 under the thrust of the springs 15 and 16, is actually retained by the rods 23 and 24, which are themselves retained by the sliding piece 19 butting against the intermediate wall 4 of the rail. For the same reason, the sliding piece 10 is held bearing against the other side of th is wall 4.

Between them, the jaw 11 and the supports 20 and 21 define a transverse recess 26 having a notch-shaped profile (FIGS. 2 and 3) widening in its upper part. On the side next to the jaw 11, this profile has an oblique side 27 inclined in the direction of the supports 20 and 21, while the opposite side 28 of the notch is rounded. A heart-shaped cam 29, suspended in its upper part about a transverse pin 30 carried by the supports 20 and 2 1, is mounted between the supports 20 and 21. When the notch 26 is free, the cam 29 occupies, under the effect of its own weight and optionally an auxiliary spring, the position 29' represented by dots and dashes, that is to say it penetrates into the notch 26. The cam 29 penetrates into the notch 26 by a cylindrical convex face 31.

The plate 1 is also provided at one of its ends with a lever 32 which is articulated, about a pin 33 transverse to the plate, in a notch 34 of the plate. A tie 36 whose bent end 37 is located, at rest, slightly in front of the cam 29, at the border of the notch 26, is attached to this lever 32 at a point 35. In this position, the lever 32 is held butting against the top of the plate 1 by a spring (not shown), for example a torsion spring mounted about the pin 33.

This binding is intended to hold a boot whose sole 42 is fitted with a cylindrical transverse metal bar 38 in a central hollow 39 of the sole by means of a metal stirrup. The diameter of the bar 38 is such that the lower part of the profile of the recess 26 has a width substantially equal to the diameter of the bar 38. This width is substantially constant in the lower part of the notch 26 and increases in the upper part.

Before the boot is fitted in the binding, the cam 29 occupies the position 29'. When the boot is being fitted in the binding, the bar 38 encounters the cam 29 and pushes it away without effort. The cam 29 then returns to bear against the bar 38, as shown. In this position, a wrenching force directed upward exerted on the bar 38 tends to move the cam 29 with it by friction and consequently reduce the width of the notch 26 owing to the eccentricity of the working face 31 of the cam. The bar 38 is consequently retained in the notch 26. The slope at the point of contact between the cam 29 and the bar 38 is great enough to lock the cam, but nevertheless not strong enough for this locking to prevent the cam 29 from being moved away from the bar 38 with ease by the tie 36 by means of an action on the lever 32, as indicated by the arrow, FIG. 2. This boot-removal action takes place without stressing the springs 15 and 16.

In the event of falling, that is to say a force on the bar 38 exceeding a certain value, the bar moves the jaw 11 and the cam 29 apart from one another by compressing the springs 15 and 16, and disengages from the notch 26. This can occur both owing to pulling forces lying in a plane passing through the axis of the bar and owing to a torque tending to rotate the bar in a horizontal plane. Since the system is in principle balanced, the two sliding pieces 10 and 19 are both moved away from the rib 4 and the piece 19 moves the piece 9 along with it.

The precompression of the springs 15 and 16, that is to say the hardness upon release of the binding, can be adjusted by means of the screw 18. The setting is displayed by an index 40 which, in the example represented, consists of a notch in the piston 13, this notch being visible through a slot 41 in the piece 10.

According to an alternative embodiment, the pieces 9 and 19 could be fixed to the plate 1, only the jaw 11 being mobile in this case.

As represented, the boot-release lever 32 is located to the rear of the plate, that is to say behind the heel of the boot. Nevertheless, all this could be reversed of course, with the boot-release lever lying in front of the plate, and the position of the jaw 11 and of the cam 29 being altered accordingly.

Figure 5:
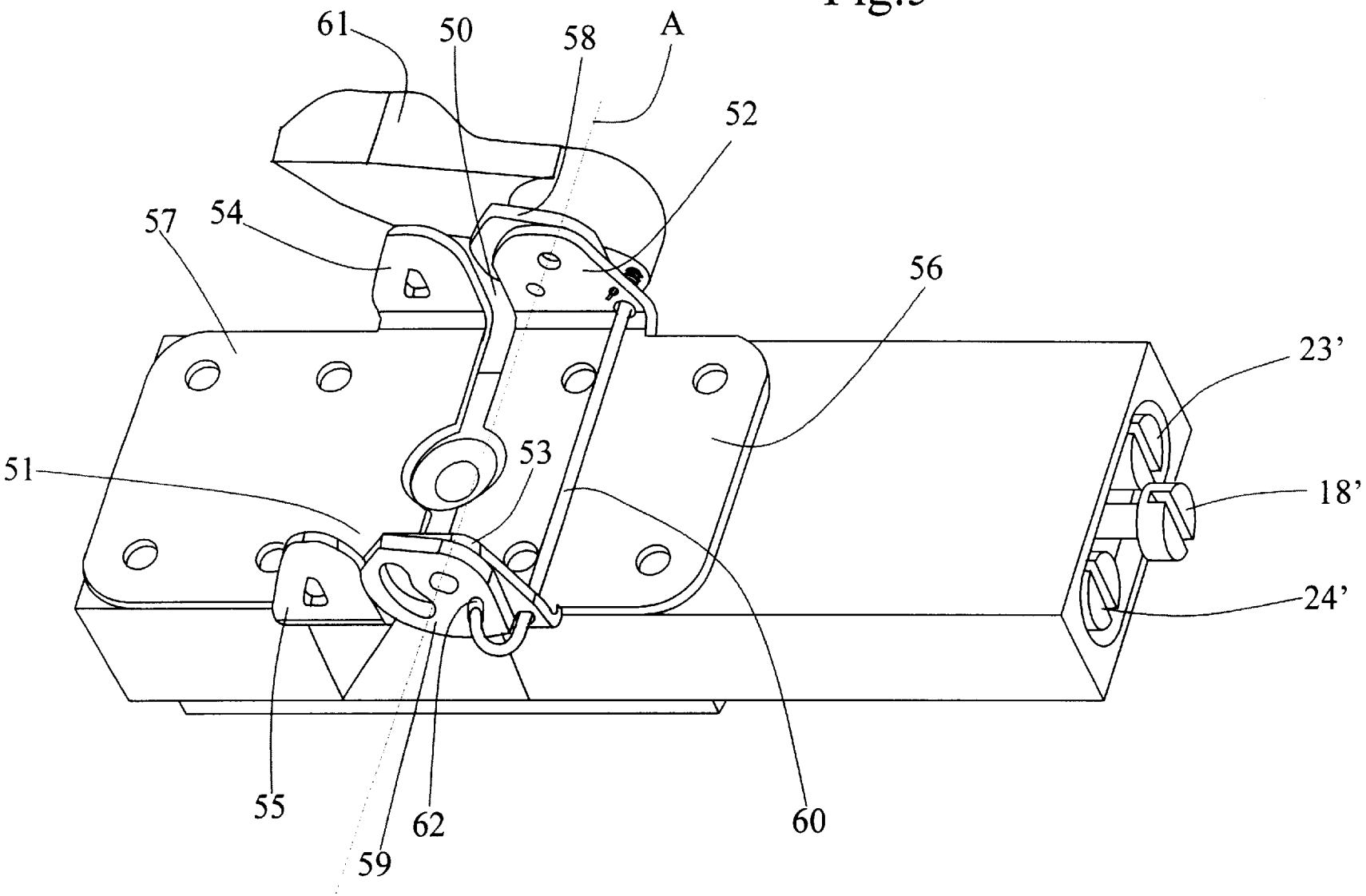
FIG. 5 is a perspective view of a second embodiment of the binding.

The second embodiment, represented in FIG. 5, can be regarded as a variant of the first embodiment. In this case, the transverse recess consists of two notches 50 and 51 formed by the bent lateral parts 52, 53 and 54, 55 of two plates 56 and 57 equivalent to the pieces 10 and 19 of the first embodiment. Two cams 58 and 59, similar to the cam 29 of the first embodiment, are mounted on the bent parts 52 and 53. The cams are articulated about an axis a and are connected to one another by a link 60 crossing the bent parts 52 and 53 through holes located at the bottom of the bent parts 52 and 53. This link 60 is also used as the rotation pin of a boot-release lever 61 acted on by a torsion spring tending to hold the boot-release lever in the lowered position as represented. On the side next to the bent part 53, the link 60 is bent two times and its end is engaged in a slit 62 of the cam 59. The spring of the boot-release lever 61 hence tends to hold the cam 59 lowered, as represented. The other cam 58 has a slit similar to the slit 62, and a finger which is secured to the lever 61 and fulfils the same role as the bent end of the link 60, is engaged in this slit. The cams are thus mechanically connected.

In order to remove the boot from the binding, the lever 61 is lifted, the effect of which is to pivot the cams downward and open the notches 50 and 51, releasing the bar 38 which, in this case, is retained at two locations close to its ends.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A boot/binding assembly for skiing wherein the binding releases in the event of falling both forward or backward and in response to twisting, the assembly comprises a boot whose sole is fitted with a transverse bar (38) and a binding which has a longitudinal direction and a transverse direction, said binding comprises a boot-retaining device (11, 29) for retaining the boot by said transverse bar, wherein the boot-retaining device located on the binding comprises a transverse recess (26) having a notch-shaped profile and which is formed between at least two retaining pieces (10, 19), said at least one retaining piece (10) can be moved longitudinally against the action of at least one spring (15, 16), and at least one self-locking cam (29) articulated about an axis transverse to the binding on one of the retaining pieces and experiencing a force tending to keep said transverse bar engaged in the transverse recess (26), said self-locking cam having a cylindrical convex face (31) being interfaceable with the transverse bar (38) such that the transverse bar, once engaged in the transverse recess after having deflected the self-locking cam, tends to move the self-locking cam with said transverse bar by friction when an upward force is exerted on the transverse bar, so that the transverse bar stays locked in the transverse recess by wedging between the self-locking cam and the retaining piece (10) which is not supporting the self-locking cam.

2. The assembly as claimed in claim 1, wherein the profile of the recess (26) has a rounded side (28) and an oblique side (27), the rounded side being next to the cam (29).

3. The assembly as claimed in claim 2 wherein the profile of the recess (26) has a lower part, an upper part and a width substantially constant in the lower part then increasing in the upper part, the width of lower part being substantially equal to the diameter of the bar (38).

4. The assembly as claimed in claim 1, wherein the two pieces (10, 19) of the retaining device can be moved longitudinally against the action of at least one common spring (15, 16) working in compression.

5. The assembly as claimed in claim 1, wherein the binding comprises a release device for releasing the boot, which comprise a lever (32) and a connecting element (36) for rotating the cam (29) in the opposite direction to its locking direction.

6. The assembly as claimed in claim 5, wherein the connecting element is a tie (36) whose bent end (37) rotates the cam (29).

7. The assembly as claimed in claim 5, wherein the lever (32) is articulated to the front or rear of the binding.

8. The assembly as claimed in claim 1, wherein the retaining device itself (11, 20, 21, 29) form upward-projecting parts of the retaining pieces (10, 19), and wherein the sole of the boot has a recess (39) intended to receive these projecting parts.

9. The assembly as claimed in claim 1, wherein the pieces (56, 57), between which transverse recess for the bar is form, define two lateral notches (50, 51) between which the bar (38) is fixed close to the ends by two cams (58, 59), that is to say one cam per notch.

10. The assembly as claimed in claim 9, wherein the pieces (56, 57) between which the transverse recess is formed consist of plates with bent edges (52, 53) forming the notches (50, 51).

11. A boot/binding assembly for skiing wherein the binding releases in the event of falling both forward or backward and in response to twisting, the assembly comprises a boot whose sole is fitted with a transverse bar (38) and a binding which has a longitudinal direction and a transverse direction, said binding comprises a boot-retaining device (11, 29) for retaining the boot by said transverse bar, wherein the boot-retaining device located on the binding comprises a transverse recess (26) having a notch-shaped profile and which is formed between at least two retaining pieces (10, 19), said at least one retaining piece (10) can be moved longitudinally against the action of at least one spring (15, 16), and at least one self-locking cam (29), said at least one self-locking cam articulated about an axis transverse to the binding on said at least one of the retaining pieces and experiencing a force tending to keep said transverse bar engaged in the transverse recess (26), said at least one self-locking cam having a cylindrical convex face (31) being interfaceable with the transverse bar (38) such that the transverse bar, once engaged in the transverse recess after having deflected the at least one self-locking cam, tends to move the at least one self-locking cam with said transverse bar by friction when an upward force is exerted on the transverse bar, so that the transverse bar stays locked in the transverse recess by wedging between the at least one self-locking cam and the retaining piece (10) which is not supporting the at least one self-locking cam, wherein the two retaining pieces (10, 19) of the retaining device can be moved longitudinally against the action of at least one common spring (15, 16) working in compression, and wherein the binding comprises a plate (1) in which a slide, divided into two parts (2, 3) separated by a wall (4), is formed, and wherein one of the retaining pieces (10) is mounted so as to slide in one (2) of these parts, while the other retaining piece (19) is mounted so as to slide in the other part (3), one of the retaining pieces (10) interacting with a piston (13) sliding in the retaining piece, the spring working in compression between the piston and the retaining piece (10).

12. The assembly as claimed in claim 11, wherein the part (2) of the slide containing the piston (13) also contains a piece (9) having a screw (18) passing through it and engaging with this screw, which bears on the piston and is retained by at least one rod (23, 24) fixed in the other retaining piece (19).

13. The assembly as claimed in claim 12, wherein the piece (9) supporting the screw and the retaining piece (19) fixed to the rod can move in the plate (1).

14. The assembly as claimed in claim 12, wherein the piece (9) supporting the screw and the retaining piece (19) fixed to the rod are fixed to the plate (1).

* * * * *